US006472116B2

(12) United States Patent
Katagiri

(10) Patent No.: US 6,472,116 B2
(45) Date of Patent: Oct. 29, 2002

(54) DRY TONER, AND ITS PRODUCTION PROCESS

(75) Inventor: Hiroshi Katagiri, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/839,685

(22) Filed: Apr. 23, 2001

(65) Prior Publication Data

US 2002/0006568 A1 Jan. 17, 2002

(30) Foreign Application Priority Data

| | | |
|---|---|---|
| Apr. 24, 2000 | (JP) | 2000-122656 |
| May 30, 2000 | (JP) | 2000-160147 |
| May 19, 2000 | (JP) | 2000-147730 |
| May 19, 2000 | (JP) | 2000-147731 |
| Dec. 27, 2000 | (JP) | 2000-397141 |

(51) Int. Cl.[7] ..... G03G 9/087
(52) U.S. Cl. ..... 430/109.5; 430/137.18
(58) Field of Search ..... 430/109.1, 109.2, 430/109.5, 137.18

(56) References Cited

U.S. PATENT DOCUMENTS

| | | | | |
|---|---|---|---|---|
| 5,714,542 A | * | 2/1998 | Niinae et al. | 525/108 |
| 6,238,835 B1 | * | 5/2001 | Tavernier et al. | 430/109 |

FOREIGN PATENT DOCUMENTS

| | | | |
|---|---|---|---|
| EP | 0 372 958 A | 6/1990 | |
| EP | 0 400 235 A | 12/1990 | |
| EP | 0 438 269 A | 7/1991 | |
| JP | 63-66564 | 3/1988 | G03G/9/08 |
| JP | 63-174061 | 7/1988 | G03G/9/08 |

OTHER PUBLICATIONS

Database WPI Section Ch, Week 199937 Derwent Publications Ltd., London, GB; AN 1999–433890 XP002173613 & JP 11 174733 A (MITA IND VO LTD), Jul. 2, 1999 *abstract* & US 6 096 467 A (Shimizu et al.) Aug.1, 2000 *abstract* * Column 17 –column 18; example 1; table 1.

Patent Abstract of Japan 63–066564, Mar. 25, 1988.

Patent Abstract of Japan 63–174061, Jul. 18, 1988.

* cited by examiner

*Primary Examiner*—John Goodrow
(74) *Attorney, Agent, or Firm*—Sughrue, Mion, PLLC

(57) ABSTRACT

The object of the present invention is to achieve a dry toner that is of improved low-temperature fixability, pulverizability, offset resistance, durability and storability as well as improved transparency and light resistance and so provides a useful color toner, and provide a dry toner production process of improved continuous productivity. The dry toner of the invention is characterized by comprising as a binder resin a polymer that is obtained by bulk polymerization of a compound having at least two isocyanate groups and a compound having at least two functional groups, each containing active hydrogen, contains an urethane bond or urea bond in its main chain and has a number-average molecular weight (Mn) of 1,500 to 20,000 as measured on a polystyrene basis.

11 Claims, 1 Drawing Sheet

DRY TONER, AND ITS PRODUCTION PROCESS

BACKGROUND OF THE INVENTION

The present invention relates to a dry toner used to develop electrostatic images in electrophotography, electrostatic recording, electrostatic printing or the like by means of heat fixing.

A dry toner is usually produced by dispersing various agents such as releasing, coloring and charge control agents in a binder resin, grinding the resultant dispersion to toner size by fine grinding means, and classifying the powders into toner particles. Depending on the development system used, the dry toner is broken down into a one-component toner and a two-component toner comprising toner particles and carrier particles.

In recent years, faster operations and lower-temperature fixation than ever before have been required for electrophotography, and binder resins forming toner particles have been required to have lower-temperature meltability, accordingly. For instance, JP-A 63-174061 discloses a dry toner containing as a binder resin a product of reaction between a compound having at least one isocyanate group and a monoalcohol and/or a product of reaction between a compound having at least two hydroxyl groups and a monoisocyanate, and shows that these reaction products are each a low-molecular compound having a low melting point. Although this binder resin has an effect on fixing temperature decreases through its low melting point, yet some problems remain unsolved; decreased offset resistance and limited toner durability may otherwise cause filming with respect to transfer rolls, etc., and storability and blocking resistance become worse.

Likewise, JP-A 63-66564 discloses a dry toner containing as a binder a product of reaction between a compound having at least one hydroxyl or amino group and a monoisocyanate or polyisocyanate compound, and shows that the reaction product is a compound having substantially a single molecular weight of 500 or less and a melting point of 50 to 150° C. Although this binder has an effect on fixing temperature decreases through its low melting point for the same reason as mentioned above, yet such problems as mentioned above again remain unsolved.

To meet demands for much faster operations and much lower-temperature fixation, an internal dispersion type of oilless fixing toner particle system with a releasing agent dispersed in a binder resin is now proposed. For instance, JP-A 09-34170 discloses a dry toner comprising a binder resin, a coloring agent and a releasing agent, and teaches that the binder resin comprises an urethane resin as an example and has an average molecular weight of 50,000 or greater and the releasing agent has a specific melting point, so that the toner can be improved in terms of low-temperature fixability, offset resistance and blocking resistance. However, the addition of the releasing agent causes internal cohesive force to become weak, and so care must be taken so as to compensate for offsets such as deposition of toner onto a fixing roller. To shirk this, the content of the releasing agent must be increased. As a result, however, toner durability does not only become worse but it is also difficult to achieve the optimum dispersing conditions for the releasing agent, the optimum grinding conditions, etc. In addition, the incorporation of the releasing agent in the amount than required offers a transparency problem, for instance, in the case of a color toner.

Generally, styrene-acrylic copolymers are used for toner binders. For example, JP-A 06-27731 discloses to carry out polymerization reactions in a mighty mixing machine such as a double-shaft extrusion reactor for the purpose of continuous toner binder production. However, this continuous production has a grave problem because some steps must be provided for removal of an increasing amount of unreacted monomers. Polyester resins used for toner binders as is the case with the styrene-acrylic copolymers, too, has a similar problem in conjunction with their continuous production, because water and other components must be discharged from the system for the purpose of controlling reactions at a polymerization reaction step.

Thus, a primary object of the present invention is to achieve a dry toner that is of improved low-temperature fixability, pulverizability, offset resistance, durability and storability as well as improved transparency and light resistance and so provides a useful dry color toner, and is improved in terms of continuous productivity as well, and provide a dry toner production process.

SUMMARY OF THE INVENTION

The dry toner according to the present invention is characterized by comprising as a binder resin a polymer (hereinafter called a binder polymer) that is obtained by bulk polymerization of a compound having at least two isocyanate groups (hereinafter called a polyisocyanate) and a compound having at least two functional groups, each containing active hydrogen (hereinafter called a polyactive hydrogen compound), contains an urethane bond or urea bond in its main chain and has a number-average molecular weight, Mn, of 1,500 to 20,000 as measured on a polystyrene basis.

The dry toner of the present invention is characterized in that the aforesaid compound having at least two isocyanate groups is a polyisocyanate represented by the following formula (1):

Formula (1)

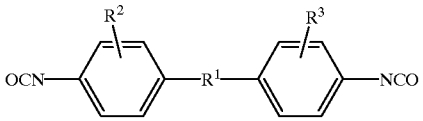

wherein $R^1$ is an alkylene group selected from the group consisting of methylene, ethylene and —$C(CH_3)_2$— groups, and $R^2$ and $R^3$ are each a group selected from the group consisting of an alkyl or alkoxy group having 4 or less carbon atoms and a halogen.

The dry toner of the present invention is characterized in that the aforesaid compound having at least two isocyanate groups is an alicyclic diisocyanate compound wherein two isocyanate groups are attached directly or via an alkylene group to a cyclic aliphatic hydrocarbon.

The dry toner of the present invention is characterized in that the aforesaid alicyclic diisocyanate compound is isophorone diisocyanate.

The dry toner of the present invention is characterized in that the aforesaid alicyclic diisocyanate compound is a polyisocyanate represented by the following formula (2):

Formula (2)

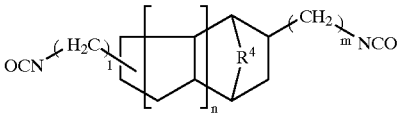

wherein $R^4$ is selected from the group consisting of a single bond, a methylene group, an ethylene group and a —$C(CH_3)_2$— group, l and m are each an integer of 1 to 5, and n is an integer of 0 to 2.

The dry toner of the present invention is characterized in that the aforesaid compound having at least two functional groups, each containing active hydrogen, is a polyoxyalkylene bisphenol A ether compound represented by the following formula (3):

Formula (3)

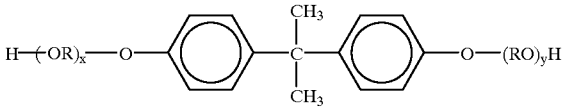

wherein R and R may be identical with or different from each other and are each an ethylene or propylene group, and x and y are each an integer of 1 or greater with the proviso that the average value of x+y is 2 to 12.

The dry toner of the present invention is characterized in that the aforesaid polymer has a weight-average molecular weight (Mw) to number-average molecular weight (Mn) ratio of 1.5 to 20.

One dry toner production process of the present invention is characterized by obtaining a polymer containing an urethane bond or urea bond in its main chain and having a number-average molecular weight (Mn) of 1,500 to 20,000 as measured on a polystyrene basis by bulk polymerization of a polyisocyanate and a polyactive hydrogen compound in the absence of any solvent, and kneading a coloring agent with the polymer, followed by grinding.

This dry toner production process is characterized in that the aforesaid bulk polymerization is continuously carried out in a belt form of reactor passing through a reaction furnace set at a reaction temperature.

This dry toner production process is characterized in that the aforesaid bulk polymerization is continuously carried out using a double-shaft extrusion reactor.

Another dry toner production process of the present invention is characterized in that:

a polyisocyanate compound and a polyactive hydrogen compound are mixed together in the absence of any solvent, a mixture is continuously fed into a double-shaft extrusion reactor built up of a barrel, a barrel inlet, a side feeder provided on an intermediate portion of said barrel and a barrel outlet from the barrel inlet for bulk polymerization, thereby obtaining a polymer containing an urethane bond or urea bond in its main chain and having a number-average molecular weight (Mn) of 1,500 to 20,000 as measured on a polystyrene basis, and a pigment-containing additive is continuously fed from said side feeder, a kneaded mixture of said pigment-containing additive and said bulk polymerization product is continuously discharged from said barrel outlet, and the thus discharged kneaded mixture is ground.

The dry toner of the present invention is of improved low-temperature fixability as well as improved pulverizability, offset resistance, durability, storability, transparency and light resistance, and the production process of the present invention lends itself to continues production.

DESCRIPTION OF THE PREFERRED EMBODIMENT

Figure 1:
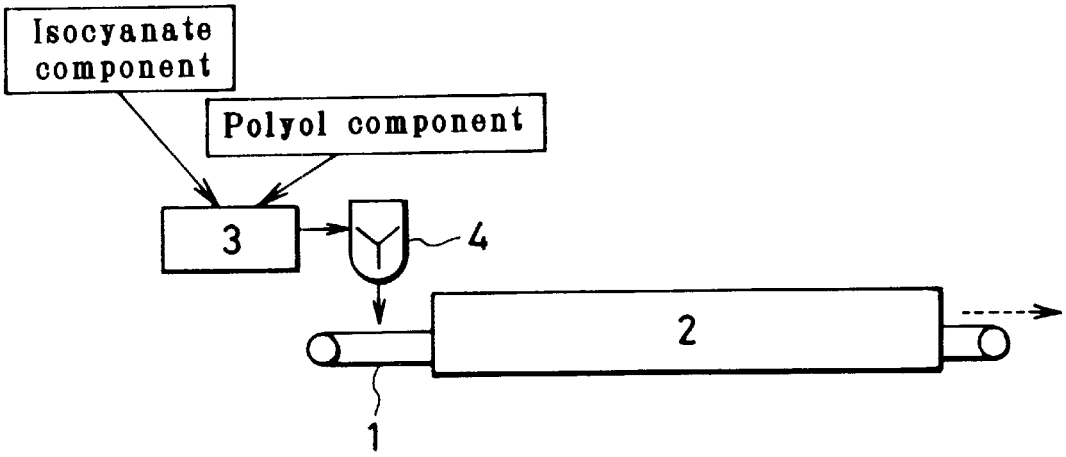
FIG. 1 is a schematic representation illustrative of how to use a belt form of reactor for the production of the binder polymer according to the present invention.

So far, high-molecular-weight resins have been used as toner binder resins, which are kneaded and finely ground with coloring agents and charge control agents into toner particles. A binder resin has functions of holding coloring agent particles, etc. in the toner particles, and depositing the toner particles onto a transfer material such as paper upon fixation due to its softening by heat and pressure produced from a fixing roller. However, when the softening point of the binder resin is lowered by the design of its molecular weight for the purpose of low-temperature fixation, the glass transition temperature and strength of the binder resin drop, ending up with drops of its ability to hold the coloring agent, offset resistance, fixed image strength, storability, etc.

A binder resin having an urethane or urea bond in its structure has an intermolecular cohesive energy of 8.74 kcal/mol that is much larger than, for instance, 0.68 kcal/mol for a methylene bond (—$CH_2$—), 1.0 kcal/mol for an ether bond (—O—), 3.9 kcal/mol for a benzene bond and 2.9 kcal/mol for an ester bond or, in another parlance, has a high glass transition point due to its high crystallizability.

On the other hand, a high-molecular-weight polyurethane resin has a high softening point and so offers a problem in connection with low-temperature fixability. Moreover, when this resin is used as a binder resin, a problem arises in conjunction with grindability because of its high elasticity. The present invention has been accomplished on the basis of findings that a resin containing an urethane bond or urea bond in its structure, when having a number-average molecular weight of 1,500 to 20,000 as measured on a polystyrene basis, can have a flow softening point of 140° C. or lower, is improved in terms of low-temperature fixability in association with molecular weight reductions, can have a glass transition temperature of 55° C. or higher in spite of its decreased softening point, and is limited in terms of the degrees of decreases in its glass transition temperature and strength, so that it can provide a toner binder resin improved in terms of the ability to hold a coloring agent, offset resistance, fixed image strength, storability, etc.

The polymer of the present invention contains as a binding element an urethane bond (—A—NHCOO—B— wherein A is a polyisocyanate residue and B is a polyactive hydrogen compound residue) resulting from the reaction between a hydroxyl group and an isocyanate group) or an urea bond (—NHCONH—) resulting from the reaction between an amino group and an isocyanate group.

The term "polyisocyanate" used herein, for intance, includes aliphatic diisocyanates such as ethane diisocyanate, propane diisocyanate, butene diisocyanate, butane diisocyanate, thiodiethyl diisocyanate, pentane diisocyanate, β-methylbutane diisocyanate, hexane diisocyanate, ω,ω'-dipropyl ether diisocyanate, thiodipropyl diisocyanate, heptane diisocyanate, 2,2-dimethylpentane diisocyanate, 3-methoxyhexane diisocyanate, octane diisocyanate, 2,2,4-trimethylpentane diisocyanate, nonane diisocyanate, decane diisoyanate, 3-butoxyhexane diisocyanate, 1,4-butylene glycol dipropyl ether-ω,ω'-diisocyanate, undecane diisocyanate, dodecane diisocyanate, and thiodihexyl diisocyanate.

The polyisocyanate includes aliphatic diisocyanates having a cyclic group, for instance, ω,ω'-1,3-dimethylbenzene diisocyanate, ω,ω'-1,2-dimethylbenzene diisocyanate, ω,ω'1,2-dimethylcyclohexane diisocyanate, ω,ω'-1,4-dimethylcyclohexane diisocyanate, ω,ω'-1,4-diethylbenzene diisocyanate, ω,ω'-1,4-dimethylnaphthalene diisocyanate, ω,ω'-1,5-dimethylnaphthalene diisocyanate, 3,5-dimethylcyclohexane-1-methylisocyanato-2-propyl isocyanate, and ω,ω'n-propyl-biphenyl diisocyanate.

The polyisocyanate includes aromatic diisocyanates, for instance, 1,3-phenylene diisocyanate, 1,4-phenylene diisocyanate, 1-methylbenzene-2,4-diisocyanate, 1-methylbenzene-2,5-diisocyanate, 1-methylbenzene-3,5-diisocyanate, 1,3-dimethylbenzene-2,4-diisocyanate, 1,3-dimethylbenzene-4,6-diisocyanate, 1,4-dimethylbenzene-2,5-diisocyanate, 1-ethylbenzene-2,4-diisocyanate, 1-isopropylbenzene-2,4-diisocyanate, diethylbenzene diisocyanate, and diisopropylbenzene diisocyanate.

The polyisocyanate includes nathalene diisocyanates, for instance, naphthalene-1,4-diisocyanate, naphthalene-1,5-diisocyanate, naphthalene-2,6-diisocyanate, naphthalene-2,7-diisocyanate, and 1,1'-dinaphtyl-2,2'-diisocyanate.

The polyisocyanate includes biphenyl diisocyanates, for instance, biphenyl-2,4'-diisocyanate, biphenyl-4,4'-diisocyanate, 3,3'-dimethylbiphenyl-4,4'-diisocyanate, 3,3'-dimethoxybiphenyl-4,4'-diisocyanate, and 2-nitrobiphenyl-4,4'-diisocyanate.

The polyisocyanate includes di- or tri-phenylmethane diisocyanates and di- or tri-phenylethane diisocyanates, for instance, diphenylmethane-4,4'-diisocyanate, 2,2'-dimethyldiphenylmethane-4,4'-diisocyanate, diphenyldimethylmethane-4,4'-diisocyanate, 2,5,2',5'-tetramethyldiphenylmethane-4,4'-diisocyanate, 3,3'-dimethoxydiphenylmethane-4,4'-diisocyanate, 4,4'-dimethoxybiphenyl-3,3'-diisocyanate, 4,4'-diethoxyphenylmethane-3,3'-diisocyanate, 2,2'-dimethyl-5,5'-dimethoxydiphenylmethane-4,4'-diisocyanate, 3,3-dichlorodiphenyldimethylmethane-4,4'-diisocyanate, benzophenone-3,3'-diisocyanate, α,β-diphenylmethane-2,4-diisocyanate, 3-nitrotriphenylethane-4,4'-diisocyanate, and 4-nitrotri-phenylmethane-4,4'-diisocyanate as well as their derivatives.

The polyisocyanate includes triisocyanates, for instance, 1-methylbenzene-2,4,6-triisocyanate, 1,3,5-trimethylbenzene-2,4,6-triisocyanate, naphthalene-1,3,7-triisocyanate, biphenyl-1,3,7-triisocyanate, diphenylmethane-2,4,4'-triisocyanate, 3-methyldiphenylmethane-4,6,4'-triisocyanate, triphenylmethane-4,4',4"-triisocyanate, and diphenyl-4,4'-diisocyanatocarbamic chloride as well as their derivatives.

Particularly preferable for the polyisocyanate used herein are diisocyanates having an alicyclic or aromatic hydrocarbon, for instance, diphenylmethane-4,4'-diisocyanate (MDI), isophorone diisocyanate (IPDI), norbornane diisocyanate (NBDI), dicyclohexylmethane-4,4'-diisocyanate (hydrogenated MDI), p-xylylene diisocyanate, m-xylylene diisocyanate (XDI), p-phenylene diisocyanate, p-tetramethylxylylene diisocyanate, m-tetramethylxylylene diisocyanate, 1,5-naphthalene diisocyanate, triphenylmethane triisocyanate, 1,3-bis(isocyanatomethyl) cyclohexane (hydrogenated XDI), and 2,4-tolylene diisocyanate (TDI). Alternatively, the use of mixtures of these polyisocyanates is preferred as well.

By using as the polyisocyanate such a diisocyanate as represented by the aforesaid formula (1), it is possible to obtain a polymer having improved grindability and improve the productivity of the grinding step for dry toner preparation. The diisocyanate represented by the aforesaid formula (1), for instance, includes diphenylmethane-4,4'-diisocyanate, 2,2'-dimethyldiphenylmethane-4,4'-diisocyanate, 2,2',5,5'-tetramethyldiphenylmethane-4,4'-diisocyanate, 3,3'-dimethoxydiphenylmethane-4,4'-diisocyanate, 2,2'-dimethyl-5,5'-dimethoxydiphenylmethane-4,4'-diisocyanate, 3,3'-dichlorophenylmethane-4,4'-diisocyanate, and α,β-diphenylmethane-4,4'-diisocyanate as well as their deriviatives. In this regard, it is acceptable to use mixtures of such diisocyanates.

Each of the polyisocyanates represented by the aforesaid formula (1) has a basic skeleton structure wherein two aromatic rings are attached to each other via an alkylene group. By using this polyisocyanate as a hard segment component, it would be possible to obtain a binder polymer of improved grindability because the flexibility of a molecular chain in the binder polymer can be so reduced that a rigid structure can be achieved. The basic skeleton structure wherein two aromatic rings are attached to each other via an alkylene group could increase intermolecular cohesive force and, hence, enable high-temperature offsetting to be reduced or eliminated.

By using the alicyclic diisocyanate compound as the polyisocyanate, it is possible to obtain a dry toner that enables images to be of improved light resistance and free from fading even when they are stored over an extended period of time. The alicyclic diisocyanate compound, because of having a cyclic aliphatic hydrocarbon structure, could reduce deterioration by light or heat. The obtained binder polymer is of a rigid structure of improved grindability, so that the productivity of the grinding and classification steps for dry toner production can be improved.

The alicyclic diisocyanate compound has a structure wherein two isocyanate groups are attached directly or via an alkylene group to the cyclic aliphatic hydrocarbon or polycyclic aliphatic hydrocarbon, for instance, includes an isophorone diisocyanate represented by the following structural formula:

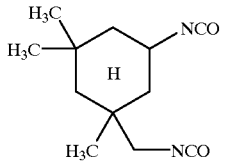

or, alternatively, ω,ω'-1,2-dimethylcyclohexane diisocyanate, ω,ω'-1,4-dimethylcyclohexane diisocyanate, and 3,5-dimethylcyclohexane-1-methyl isocyanate-2-propyl isocyanate.

The polycyclic aliphatic diisocyanate represented by the aforesaid formula (2) wherein $R^4$ is a single bond and n=1, for instance, includes 3(4), 7(8)-di(isocyanatomethyl) bicyclo[4,3,$0^{1\cdot6}$]nonane (which shall herein mean 3,7-di (isocyanatomethyl)bicyclo[4,3,$0^{1\cdot6}$]nonane, 3,8-di (isocyanatomethyl)bicyclo[4,3,$0^{1\cdot6}$]nonane, 4,7-di (isocyanatomethyl)bicyclo[4,3,$0^{1,6}$]nonane or 4,8-di(isocyanatomethyl)bicyclo[4,3,$0^{1,6}$]nonane, as will be applied hereinafter), 3(4)-isocyanatomethyl-7(8)-isocyanatoethyl-bicyclo[4,3,$0^{1,6}$]nonane, 3(4)-isocyanatoethyl-7(8)-isocyanatomethyl-bicyclo[4,3,$0^{1,6}$]nonane, 3(4)-isocyanatomethyl-7(8)-isocyanatopropyl-bicyclo[4,3,$0^{1,6}$]nonane, 3(4)-isocyanatopropyl-7(8)-isocyanatomethyl-bicyclo[4,3,$0^{1,6}$]nonane, 3(4)-isocyanatomethyl-7(8)-isocyanatobutyl-bicyclo[4,3,$0^{1,6}$]nonane, 3(4)-isocyanatomethyl-7(8)-isocyanatopentyl-bicyclo[4,3,$0^{1,6}$]nonane, 3(4)-isocyanatopentyl-7(8)-isocyanatomethyl-bicyclo[4,3,$0^{1,6}$]nonane, 3(4), 7(8)-di(isocyanatoethyl)bicyclo[4,3,$0^{1,6}$]nonane, 3(4)-isocyanatoethyl-7(8)-isocyanatopropyl-bicyclo [4,3,$0^{1,6}$]nonane, 3(4)-isocyanatopropyl-7(8)-isocyanatoethyl-bicyclo[4,3,$0^{1,6}$]nonane, 3(4)-isocyanatoethyl-7(8)-isocyanatobutyl-bicyclo[4,3,$0^{1,6}$]nonane, 3(4)-isocyanatobutyl-7(8)-isocyanatoethyl-bicyclo[4,3,$0^{1,6}$]nonane, 3(4)-isocyanatoethyl-7(8)-isocyanatopentyl-bicyclo [4,3,$0^{1,6}$]nonane, and 3(4)-isocyanatopentyl-7(8)-isocyanatoethyl-bicyclo[4,3,$0^{1,6}$]nonane.

The polycyclic aliphatic diisocyanate represented by the aforesaid formula (2) wherein $R^4$ is a methylene group and n=0, for instance, includes 2,5(6)-di(isocyanatomethyl)bicyclo[2,2,1]heptane, 2-isocyanatomethyl-5(6)-isocyanatoethyl-bicyclo[2,2,1]heptane, 2-isocyanatomethyl-5(6)-isocyanatpropyl-bicyclo[2,2,1]heptane, 2-isocyanatomethyl-5(6)-isocyanatobutyl-bicylco[2,2,1]heptane, 2-isocyanatomethyl-5(6)-isocyanatopentyl-bicyclo [2,2,1]heptane, 2,5(6)-di(isocyanatoethyl)bicyclo[2,2,1]heptane, 2-isocyanatoethyl-5(6)-isocyanatopropyl-bicyclo [2,2,1]heptane, 2-isocyanatoethyl-5(6)-isocyanatobutyl-bicyclo[2,2,1]heptane, and 2-isocyanatoethyl-5(6)-isocyanatopentyl-bicyclo[2,2,1]heptane or a norbornane diisocyanate represented by the following structural formula:

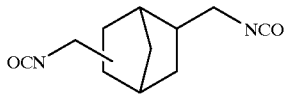

The polycyclic aliphatic diisocyanate represented by the aforesaid formula (2) wherein $R^4$ is an ethylene group and n=0, for instance, includes 2,5(6)-di(isocyanatomethyl)bicyclo[2,2,2]octane, 2-isocyanatomethyl-5(6)-isocyanatoethyl-bicyclo[2,2,2]octane, 2-isocyanatomethyl-5(6)-isocyanatpropyl-bicyclo[2,2,2]octane, 2-isocyanatomethyl-5(6)-isocyanatobutyl-bicylco[2,2,2]octane, 2-isocyanatomethyl-5(6)-isocyanatopentyl-bicyclo [2,2,2]octane, 2,5(6)-di(isocyanatoethyl)bicyclo[2,2,2]octane, 2-isocyanatoethyl-5(6)-isocyanatopropyl-bicyclo[2,2,2]octane, 2-isocyanatoethyl-5(6)-isocyanatobutyl-bicyclo [2,2,2]octane, and 2-isocyanatoethyl-5(6)-isocyanatopentyl-bicyclo[2,2,1]octane.

The polycyclic aliphatic diisocyanate represented by the aforesaid formula (2) wherein $R^4$ is a methylene group and n=1, for instance, includes 3(4), 8(9)-di(isocyanatomethyl)tricyclo[5,2,1,$0^{2,6}$]decane, 3(4)-isocyanatomethyl-8(9)-isocyanatoethyl-tricyclo[5,2,1,$0^{2,6}$]decane, 3(4)-isocyanatomethyl-8(9)-isocyanatopropyl-tricyclo[5,2,1,$0^{2,6}$]decane, 3(4)-isocyanatomethyl-8(9)-isocyanatobutyl-tricyclo[5,2,1,$0^{2,6}$]decane, 3(4)-isocyanatomethyl-8(9)-isocyanatopentyl-tricyclo[5,2,1,$0^{2,6}$]decane, 3(4), 8(9)-di(isocyanatoethyl)tricyclo[5,2,1,$0^{2,6}$]decane, 3(4)-isocyanatoethyl-8(9)-isocyanatopropyl-tricyclo[5,2,1,$0^{2,6}$]decane, 3(4)-isocyanatoethyl-8(9)-isocyanatobutyl-tricyclo [5,2,1,$0^{2,6}$]decane, and 3(4)-isocyanatoethyl-8(9)-isocyanatopentyl-tricyclo[5,2,1,$0^{2,6}$]decane.

In general, polyurethane synthesis or polyester synthesis, because of taking place through successive reactions, yields polymers having a narrow molecular weight distribution. In an urethane reaction with the polyactive hydrogen compound, however, an isophorone diisocyanate for instance can yield a polymer having a much narrower molecular weight distribution. This enables the polymer to melt by heating within a very short time and, hence, achieve sharp meltability, resulting in an increased degree of freedom in the design of binder polymer resin. While any detailed reason for this has yet to be clarified, a possible explanation could be that the isophorone diisocyanate has a primary isocyanate group and a secondary isocyanate group which differ in reactivity and so give rise to selectivity for the reactions involved.

When the isophorone diisocyanate is used in combination with other polyisocyanate, the isophorone diisocyanate should preferably account for 60% by weight or less of all isocyanate components. When the proportion of other polyisocyanate is too high, the effect on light resistance and sharp meltability becomes slender.

The polyactive hydrogen compound used herein, for instance, polyols, polyamines, etc. Exemplary polyols are hydrogenated bisphenol A, an ethylene oxide addition product of bisphenol A, a propylene oxide addition product of bisphenol A, polyethylene glycol, polypropylene glycol, polytetramentylene glycol, poly(caprolactonepolyol), poly(hexamethylene carbonate), bis(2-hydroxyethyl)terephthalate, cyclohexanedimethanol, dimethylol propionate, dimethylol butanoate, polyethylene adipate, polypropylene adipate, and polyhexamethylene adipate.

Examples of the polyamines used as the polyactive hydrogen compound are diamines such as hexamethylenediamine, 1,7-diaminoheptane, 1,8-diaminooctane, 1,9-diaminononane, o-phenylenediamine, and m-phenylenediamine.

When the polyoxylalkylene bisphenol A ether compound represented by the aforesaid formula (3) is used as the polyactive hydrogen compound, it is possible to obtain a dry toner of improved grindability. The polyoxyalkylene bisphenol A ether compound represented by the aforesaid formula (3), for instance, includes an addition product obtained by adding 2 to 12 moles of ethylene oxide to bisphenol A (hereinafter called an EO addition product), and an addition product obtained by adding 2 to 12 moles of propylene oxide to bisphenol A (hereinafter called a PO addition product), which may be used alone or in combination. It is also acceptable to use two or more compounds varying in the number of repeating EO or PO group units. When they are used in combination, the mixing ratio (molar ratio) should be EO addition product/PO addition product=8:2 to 1:9, preferably 8:2 to 2:8, and more preferably 7:3 to 4:6.

In formula (3), R and R may be identical with or different from each other; one may be an ethylene group while another may be a propylene group. The EO group, and PO group varies in physical properties upon formed into a binder polymer depending on the number of their repeating units. The average value of x+y should be 2 to 12, and preferably 2 to 4. Exceeding the upper limit to the number of repeating units is not preferable because glass transition temperature becomes low and grindability becomes worse. At too small an average value, on the other hand, strength becomes low with a decreasing bending and peeling strength. An increased proportion of the EO component enables fixing strength (bending and peeling strength) to be enhanced, but incurs a drop of glass transition temperature with a decreasing grindability. When the proportion of the PO component is high, on the contrary, grindability becomes high but fixing strength (bending and peeling strength) becomes low. The polyoxyalkylene bisphenol A ether compound should have a hydroxyl group value of 100 to 350 KOHmg/g, and preferably 200 to 290 KOHmg/g.

The polyoxylalkylene bisphenol A ether compound represented by formula (3) contains bisphenol A in the form of a basic skeleton. This could yield a rigid structure with a limited flexibility of molecular chain, when the polyoxylalkylene bisphenol A ether compounds reacts with the polyisocyanate to yield a binder polymer, and so provide a dry toner of improved grindability.

The binder polymer of the present invention has a medium number-average molecular weight (Mn) of 1,500 to 20,000, with its chemistries depending largely on the chemical structures of the polyisocyanates and polyactive hydrogen compounds that are its constituents. For the aforesaid polyisocyanates it is preferable to use several types of polyisocyanates in admixture, and for the polyactive hydrogen compounds it is again preferable to use several types of polyactive hydrogen compounds in admixture. The properties of the binder polymer may be controlled by making an appropriate selection from reasonable combinations. For instance, preference is given to a mixture of an alicyclic polyisocyanate with an aromatic polyisocyanate, and a mixture of an ethylene oxide addition product of bisphenol A with a propylene oxide addition product of bisphenol A.

The proportion of the polyisocyanates and polyactive hydrogen compound should be determined in such a way that the ratio of the number of active hydrogen groups in the polyactive hydrogen compound with respect to the number of isocyanate groups in the polyisocyanate (NCO/active hydrogen) is in the range of 0.5 to 1.0, and preferably 0.7 to 1.0 during reaction.

For binder polymer production, the bulk polymerization of the polyactive hydrogen compound with the polyisocyanates should preferably be carried out a temperature of 30° C. to 180° C., preferably 30° C. to 140° C. under atmospheric pressure in the absecne of any solvent for a few minutes to a few tens of hours. The catalyst used herein, for instance, includes dibutyltin dichloride, dimethyltin dichloride, octylic acid tin salt, triphenylammonium dichloride, triethylamine, N,N-dimethylcyclohexylamine, triethylenediamine, and dimethylaminoethanol.

The binder polymer of the present invention may be produced by bulk polymerization in a vessel. According to this bulk polymerization, any operation for removal of solvents or by-product water is dispensed with because no solvent is needed unlike solution polymerization and no by-product is produced unlike polycondensation reactions. With the bulk polymerization, it is thus possible to carry out reactions between the polyactive hydrogen compounds and the polyisocyanates in a solventless state and so achieve efficient continuous production.

The continuous binder polymer production process of the present invention is now explained with reference to FIGS. 1 and 2. How to use a belt type reactor system is schematically illustrated in FIG. 1 wherein reference numeral 1 stands for a conveyor, 2 a reactor, 3 a metering feeder, and 4 a mixer.

Referring to the belt type reactor system, the polyactive hydrogen compound and polyisocyanates are weighed in the metering feeder 3 so that they can be fed at a given proportion. After this, the feed materials are mixed together in the mixer 4, from which the feed mixture is fed onto the conveyor 1. The conveyor 1 may be built up of a belt form of reactor vessel, and the reactor 2 may have a tunnel structure. By rotationally driving the conveyor 1 in the reactor 2 the feed mixture is fed into the reactor 2 from its inlet, and the reaction product is discharged from the reactor 2 through its outlet. Within the reactor 2, the feed mixture is controlled at a reaction temperature of 30° C. to 180° C. The length of reactor 2 and the speed of movement of conveyor 1 are properly determined depending on the conditions required for promoting the polymerization reaction involved. In order to bring the reaction to completion, the reaction product discharged from the conveyor 1 may be thermally treated at 60° C. to 180° C. for 15 minutes to 10 hours in an atmospheric furnace. The thus obtained binder polymer is kneaded with pigment-containing additives through a double-shaft kneader or the like, and then formed into a toner through grinding and classification steps.

Figure 2:
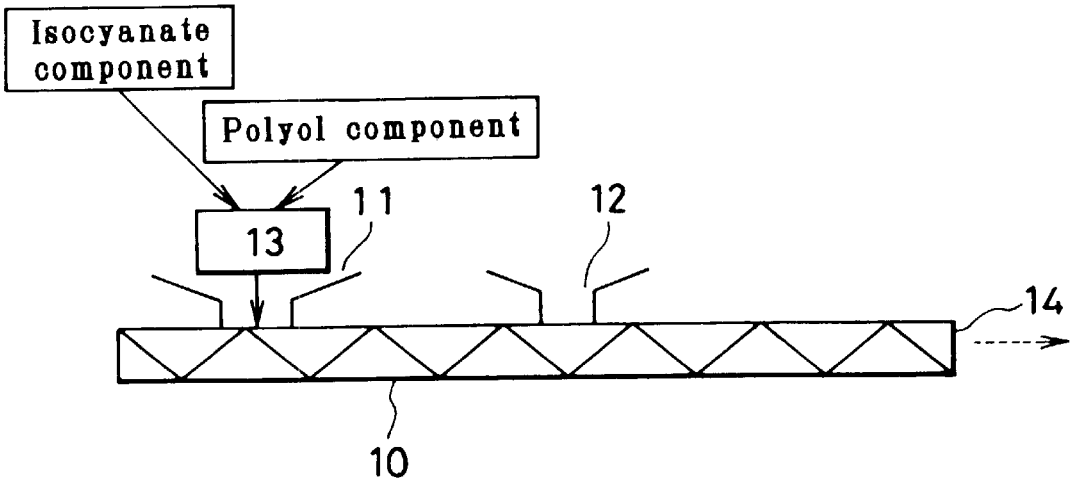
FIG. 2 is a schematic representation illustrative of how to use a double-shaft extrusion reactor for the production of the binder polymer according to the present invention.

How to use a reactor system relying upon a double-shaft extrusion reactor is schematically illustrated in FIG. 2 wherein reference numeral 10 stands for a double-shaft extrusion reactor (barrel), 11 a raw material feed inlet, 12 a side feeder, 13 a metering feeder and 14 a product discharge outlet.

In the reactor system using a double-shaft extrusion reactor, the polyactive hydrogen compound and polyisocyanates are weighed in the metering feeder 3 so that they can be fed at a given proportion. After this, the feed materials are fed from the raw material feed inlet 11 into the barrel at a rate of 1 to 10 kg/hour. The barrel 10 may be operated at an L/D value of 5 to 150, an inlet temperature of 50° C. to 250° C., an intermediate temperature of 30° C. to 250° C. and an outlet temperature of 30° C. to 250° C. for a residence time of 1 to 60 minutes. In order to bring the reaction to completion, the binder polymer produced through the double-shaft extrusion reactor may be thermally treated at 60° C. to 180° C. for 15 minutes to 10 hours in an atmospheric furnace. The thus obtained binder polymer is kneaded with additives such as pigments and charge control agents, and then formed into a toner through grinding and classification steps.

In the case of the aforesaid binder polymer production, the double-shaft extrusion reactor is used exclusively for the polymerization reaction. However, it is acceptable to allow the polymerization reaction to take place between the raw material feed inlet 11 and the side feeder 12, feed the given amounts of additives such as charge control agents and pigments from the side feeder 12, and discharge a kneaded product comprising the binder polymer, charge control agent and pigment from the product discharge outlet 14. Preferably in this case, the water contents of the charge control agent and pigment should be reduced so as to avert adverse influences on the polymerization degree of the binder polymer, etc. It is also preferable that the additives have a structure free from any reactive group for the polyisocyanates.

The binder polymer of the present invention should have a number-average molecular weight (Mn) of 1,500 to 20,000, preferably 2,000 to 10,000 and more preferably 3,000 to 8,000 as measured on a polystyrene basis. A binder polymer having a number-average molecular weight (Mn) less than 1,500, albeit being excellent in low-temperature fixability, is poor in the ability to hold a coloring agent, filming resistance, offset resistance, fixed image strength and storability. A binder polymer having a number-average molecular weight greater than 20,000 cannot be used by itself because of being poor in low-temperature fixability.

The binder polymer of the present invention should have a weight-average molecular weight (Mw) of 3,000 to 300, 000, preferably 5,000 to 50,000 and more preferably 8,000 to 20,000, with Mw/Mn being 1.5 to 20, preferably 1.8 to 10 and more preferably 1.8 to 5. To make a sensible tradeoff between the offset resistance and the meltability of a certain resin, usually, the resin has been designed in such a way that its Mw/Mn is increased, viz., it has a broad molecular weight distribution or, alternatively, the resin has been produced by blending together separately prepared low-molecular-weight polymer and high-molecular-weight polymer. However, a binder polymer having an increased Mw/Mn or comprising such a blend becomes low in terms of transparency due to its no sharp meltability, offering a color image quality problem in particular. The binder polymer of the present invention, on the contrary, is of sharp meltability and excellent transparency due to its narrow molecular weight distribution, and so can ensure a color image of high quality. This binder polymer is also of improved high-temperature offset resistance because internal cohesive force is maintained upon thermal melting by the high intermolecular cohesive energy of its urethane bond or urea bond.

Referring here to control of the molecular weight of the binder polymer, the lower the proportion of the number of active hydrogen groups in the polyactive hydrogen compound with respect to the number of isocyanate groups in the polyisocyanate (NCO/active hydrogen), the lower the molecular weight thereof can be. With that proportion close to the equimolar ratio, it is possible to increase the molecular weight of the binder polymer. Thus, proper molecular weight control can be easily gained by control of the number of moles of the polyisocyanate and polyactive hydrogen compound that take part in the reaction involved.

It is here noted that suitable chain extenders may be used on condition that they have no influences on the physical properties of the binder polymer according to the present invention. The chain extenders used herein, for instance, may be ethylene glycol, propylene glycol, 1,4-butanediol, bis-(β-hydroxy)benzene, and trimethylolpropane.

The binder polymer of the present invention should have a flow softening point (Tm) of 90° to 140° C., preferably 90° C. to 120° C. and more preferably 100° C. to 110° C. A binder polymer having a flow softening point (Tm) lower than 90° C. is poor in filming resistance whereas a binder polymer having a flow softening point exceeding 140° C. is poor in low-temperature fixability. The binder polymer of this invention should have a glass transition temperature (Tg) of 50° C. to 90° C., preferably 55° C. to 80° C. and more preferably 60° C. to 70° C. A binder polymer having a glass transition temperature (Tg) lower than 50° C. is poor in storability whereas a binder polymer having a glass transition temperature exceeding 90° C. is poor in low-temperature fixability with an increasing Tm.

The binder polymer of the present invention can make a reasonable tradeoff between high Tm and low Tg, because its large intermolecular bonding force and its high crystallizability enable the magnitude of a decreasing Tg to be reduced when molecular design is performed in such a way that the molecular weight decreases with a decreasing Tm. The binder polymer of this invention can also have a melt viscosity of $3\times10^3$ to $1.5\times10^4$ Pa·s upon a 50% rate of efflux, and so lends itself to an oilless fixing toner.

Other binder resins may be added to the binder polymer of the present invention on condition that they are not detrimental to the properties of the binder polymer. Other binder resins may either coexist with the binder polymer to be produced or be kneaded with the binder polymer after production. When other binder resins coexist with the binder polymer to be produced by this invention, they should be free from any reactive group for the polyisocyanates.

The aforesaid other binder resins used herein, for instance, are styrene resins or homopolymers or copolymers containing styrene or substituted styrene such as polystyrene, poly-α-methylstyrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-acrylate-methacrylate copolymers, styrene-α-methyl chloroacrylate copolymers and styrene-acrylonitrile-acrylate copolymers, polyester resins, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, ketone resins, ethylene-ethyl acrylate copolymers, xylene resins, polyvinyl butyral resins, terpene resins, phenol resins, and aliphatic or alicyclic hydrocarbon resins, which may be used singly or in admixture.

The dry toner of the present invention comprises a binder resin comprising the binder polymer produced as mentioned above and other resin added thereto if required, (note that the term "binder resin" used herein is understood to include the binder polymer of this invention and other resin(s)), a coloring agent and a charge control agent.

For the coloring agent, various organic or inorganic pigments and dyes of various colors may be used. Exemplary black pigments are carbon black, copper oxide, triiron tetraoxide, manganese dioxide, Aniline Black, and activated carbon. Exemplary yellow pigments are chrome yellow, zinc yellow, cadmium yellow, yellow iron oxide, Mineral Fast Yellow, nickel titanium yellow, Naval Yellow, Naphthol Yellow S, Hansa Yellow G, Hansa Yellow 10G, Benzidine Yellow G, Benzidine Yellow GR, Quinoline Yellow Lake, Parmanent Yellow NCG and Tartrazine Lake. Exemplary orange pigments are red chrome yellow, molybdenum orange, Permanent Orange GTR, Pyrazolone Orange, Vulcan Orange, Indanthrene Brilliant Orange RK, Benzidine Orange G and Indanthrene Brilliant Orange GKM. Exemplary red pigments are red iron oxide, cadmium red, red lead, mercury sulfide, cadmium, Permanent Red 4R, Lithol Red, Pyrazolone Red, Watchung Red, calcium salt, Lake Red D, Brilliant Carmine 6B, eosine lake, Rhodamine Lake B, Alizarine Lake and Brilliant Carmine 3B. Exemplary violet pigments are manganese violet, Fast Violet B and Methyl Violet Lake. Exemplary blue pigments are Prussian blue, cobalt blue, alkali blue lake, Victoria Blue Lake, Phthalocyanine Blue, metal-free Phthalocyanine Blue, a partially chlorinated pigment of Phthalocyanine Blue, Fast Sky Blue and Indanthrene Blue BG. Exemplary green pigments are chrome green, chromium oxide, Pigment Green B, Malachite Green Lake and Final Yellow Green G. Exemplary white pigments are zinc white, titanium oxide, antimony white and zinc sulfide. Exemplary extender pigments are barite powders, barium carbonate, clay, silica, white carbon, talc and alumina white. Various dyes such as basic, acidic, disperse and direct dyes, for instance, include Nigrosine, Methylene Blue, Rose Bengale, Quinoline Yellow and Ultramarine Blue.

For coloring agents used with a light-transmitting color toner, various pigments and dyes of various colors may be used as recounted below. Exemplary yellow pigments are C.I. 10316 (Naphthol Yellow S), C.I. 11710 (Hansa Yellow 10G), C.I. 11660 (Hansa Yellow 5G), C.I. 11670 (Hansa Yellow 3G), C.I. 11680 (Hansa Yellow G), C.I. 11730 (Hansa Yellow GR), C.I. 11735 (Hansa Yellow A), C.I.

11740 (Hansa Yellow NR), C.I. 12710 (Hansa Yellow R), C.I. 12720 (Pigment Yellow L), C.I. 21090 (Benzidine Yellow), C.I. 21095 (Benzidine Yellow G), C.I. 21100 (Benzidine Yellow GR), C.I. 20040 (Permanent Yellow NCG), C.I. 21220 (Vulcan Fast Yellow 5) and C.I. 21135 (Vulcan Fast Yellow R). Exemplary red pigments are C.I. 12055 (Sterling I), C.I. 12075 (Permanent Orange), C.I. 12175 (Lithol Fast Orange 3GL), C.I. 12305 (Permanent orange GTR), C.I. 11725 (Hansa Yellow 3R), C.I. 21165 (Vulcan Fast Orange GG), C.I. 21110 (Benzidine Orange G), C.I. 12120 (Permanent Red 4R), C.I. 1270 (Para Red), C.I. 12085 (Fire Red), C.I. 12315 (Brilliant Fast Scarlet), C.I. 12310 (Permanent Red F2R), C.I. 12335 (Permanent Red F4R), C.I. 12440 (Permanent Red FRL), C.I. 12460 (Permanent Red FRLL), C.I. 12420 (Permanent Red F4RH), C.I. 12450 (Light Fast Red Toner B), C.I. 12490 (Permanent Carmine FB) and C.I. 15850 (Brilliant Carmine 6B). Exemplary blue pigments are C.I. 74100 (metal-free Phthalocyanine Blue), C.I. 74160 (Phthalocyanine Blue) and C.I. 74180 (Fast Sky Blue).

These coloring agents may be used singly or in combination of two or more. However, the coloring agent(s) should preferably be used in an amount of 1 to 20 parts by weight, and especially 2 to 10 parts by weight per 100 parts by weight of binder resin. At greater than 20 parts by weight the fixability and transparency of the toner become low whereas at less than 1 part by weight any desired image density may not be obtained.

It is not always necessary to add a releasing agent to the dry toner of the present invention because the binder polymer is of improved heat meltability. When the releasing agent is added to the dry toner, however, it is used in an amount of about 0 to about 3 parts by weight per 100 parts by weight of binder resin, so that oilless fixation can be achieved.

Exemplary releasing agents are paraffin wax, polyolefin wax, modified wax having an aromatic group, hydrocarbon compounds having an alicyclic group, natural wax, long-chain carboxylic acids having a hydrocarbon long chain with at least 12 carbon atoms [an aliphatic carbon chain of $CH_3(CH_2)_{11}$ or $CH_3(CH_2)_{12}$ or greater] or their esters, metal salts of fatty acids, fatty acid amides and fatty acid bisamides. Mixtures of different low-softening-point compounds may also be used to this end. To be more specific, use may be made of Paraffin Wax (Nippon Oil Co., Ltd.), Paraffin Wax (Nippon Seiro Co., Ltd.), Micro Wax (Nippon Oil Co., Ltd.), Microcrystalline Wax (Nippon Seiro Co., Ltd.), Hard Paraffin Wax (Nippon Seiro Co., Ltd.), PE-130 (Hoechst Co., Ltd.), Mitsui High Wax 110P (Mitsui Petrochemical Industries, Ltd.), Mitsui High Wax 220P (Mitsui Petrochemical Industries, Ltd.), Mitsui High Wax 660P (Mitsui Petrochemical Industries, Ltd.), Mitsui High Wax 210P (Mitsui Petrochemical Industries, Ltd.), Mitsui High Wax 320P (Mitsui Petrochemical Industries, Ltd.), Mitsui High Wax 410P (Mitsui Petrochemical Industries, Ltd.), Mitsui High Wax 420P (Mitsui Petrochemical Industries, Ltd.), Modified Wax JC-1141 (Mitsui Petrochemical Industries, Ltd.), Modified Wax JC-2130 (Mitsui Petrochemical Industries, Ltd.), Modified Wax JC-4020 (Mitsui Petrochemical Industries, Ltd.), Modified Wax JC-1142 (Mitsui Petrochemical Industries, Ltd.), Modified Wax JC-5020 (Mitsui Petrochemical Industries, Ltd.), beeswax, carnauba wax and montan wax. Exemplary metal salts of fatty acids are zinc stearate, calcium stearate, magnesium stearate, zinc oleate, zinc palmitate and magnesium palmitate.

For the polyolefinic waxes, for instance, use may be made of low-molecular-weight polypropylene, low-molecular-weight polyethylene, oxidized polypropylene and oxidized polyethylene. To be more specific, use may be made of non-oxidized polyethylene waxes such as Hoechst Wax PE520, Hoechst Wax PE130 and Hoechst Wax PE190, all made by Hoechst Co., Ltd., Mitsui High Wax 200, Mitsui High Wax 210, Mitsui High Wax 210M, Mitsui High Wax 220 and Mitsui High Wax 220M, all made by Mitsui Petrochemical Industries, Ltd., Sun Wax 131-P, Sun Wax 151-P and Sun Wax 161-P, all made by Sanyo Chemical Industries, Ltd.), oxidized polyethylene waxes such as Hoechst Wax PED121, Hoechst Wax PED153, Hoechst Wax PED521, Hoechst Wax PED522, Hoechst Wax Ceridust 3620, Hoechst Wax Ceridust VP130, Hoechst Wax Ceridust VP5905, Hoechst Wax Ceridust VP9615A and Hoechst Wax Ceridust TM9610F and Hoechst Wax Ceridust 3715, all made by Hoechst Co., Ltd., Mitsui High Wax 420M made by Mitsui Petrochemical Industries, Ltd., and Sun Wax E-300 and Sun Wax 250P, all made by Sanyo Chemical Industries, Ltd., non-oxidized polypropylene waxes such as Hoechst Wachs PP230 made by Hoechst Co, Ltd., Biscol 330-P, Biscol 550-P and Biscol 660P, all made by Sanyo Chemical Industries, Ltd., and oxidized polypropylene waxes such as Biscol TS-200 made by Sanyo Chemical Industries, Ltd. These releasing agents may be used alone or in combination of two or more. For the releasing agent added if required, it is preferable to use a releasing agent having a softening point (melting point) of 40 to 130° C. and especially 50 to 120° C. as defined by an endothermic main peak value on a DSC endothermic curve measured by DSC120 made by Seiko Instrument Co., Ltd.

For the charge control agent, any desired organic or inorganic charge control agents may be used with the proviso that they can give positive or negative charges by triboelectrification.

Exemplary positive charge control agents are Nigrosine Base Ex (made by Orient Chemical Industries, Ltd.), Quaternary Ammonium Salt P-51 (made by Orient Chemical Industries, Ltd.), BONTRON N-01 (made by Orient Chemical Industries, Ltd.), Sudan Chief Schwalts BB (Solvent Black 3: Color Index 26150), Fet Schwalts HBN (C.I. No. 26150), Brilliant Spilit Schwalts TN (Farben Fabricken Bayer K.K.), Pomelo Schwalts (Farberk Hoechst Co., Ltd.), alkoxylated amine, alkylamide, and molybdic acid chelate pigments. Among others, preference is given to Quaternary Ammonium Salt P-51.

Exemplary negative charge agents are Oil Black (Color Index 26150), Oil Black BY (made by Orient Chemical Industries, Ltd.), BONTRON S-22 (made by Orient Chemical Industries, Ltd.), Salicylic Acid Metal Chelate E-81 (made by Orient Chemical Industries, Ltd.), thioindigo pigments, sulfonylamine derivatives of copper phthalocyanine, Spiron Black TRH (Hodogaya Chemical Industries, Ltd.), BONTRON S-34 (made by Orient Chemical Industries, Ltd.), Nigrosine SO (made by Orient Chemical Industries, Ltd.), Ceres Schwalts (R)G (Farben Fabricken Bayer K.K.), Chromogene Schwalts ET00 (C.I. No. 14645), and Azo Oil Black (R) (made by National Aniline Co., Ltd., among which preference is given to Salicylic Acid Metal Chelate E-81.

These charge control agents may be used alone or in combination of two or more. However, the amount of the charge control agent added to the binder resin should be 0.001 to 5 parts by weight and preferably 0.001 to 3 parts by weight per 100 parts by weight of binder resin.

In addition, suitable additives such as magnetic particles and dispersing agents may be added to the coloring resin particles.

The dry toner of the present invention may be obtained by dispersing the binder polymer, coloring agent and charge control agent with internal additives such as the releasing agent added if required by means of kneading and melting, and grinding and classifying the resultant dispersion by fine grinding means, as already explained with reference to the polymerization for the binder polymer. However, it is acceptable to extraneously add a fluidity improver to the dry toner so as to enhance its fluidity.

For the fluidity improver organic or inorganic fine powders may be used. For instance, use may be made of fine powders of fluorocarbon resins such as vinylidene fluoride, polytetrafluoroethylene and acrylic resins; fine powders of metal salts of fatty acids such as zinc strearate, calcium stearate and lead stearate; fine powders of metal oxides such as iron oxide, aluminum oxide, titanium oxide and zinc oxide; and fine powders of silica such as wet-process silica and dry-process silica which may have been surface treated with a silane coupling agent, a titanium coupling agent, silicone oil or the like. These improvers may be used singly or in admixture.

A preferable fluidity improver is a fine powder obtained by the vapor-phase oxidization of a silicone halide compound, i.e., an improver usually referred to as the so-called pyrogenic silica or fumed silica produced by conventional processes. For instance, this makes use of the pyrolytic oxidization reaction of a silicon tetrachloride gas in oxygen hydrogen flames on the basis of the following reaction scheme:

$$SiCl_4+2H_2+O_2 \rightarrow SiO_2+4HCl$$

If, in this production process, other metal halide compound such as aluminum chloride or titanium chloride is used along with the silicon halide compound, it is then possible to obtain a composite fine powder comprising silica and other metal oxide. This composite fine powder, too, is included in the preferable fluidity improver. The preferable fine powders should preferably have a mean primary particle diameter of 0.001 to 2 $\mu$m. Particular preference is given to the use of fine silica powders in the range of 0.002 to 0.2 $\mu$m in the mean primary particle diameter.

Commercially available fine silica powder products used herein and produced by the vapor-phase oxidization of silicon halide compounds are obtained under the following trade names of AEROSIL 130, 200, 300, 280, TT600, MOX170, MOX80, COK84, etc., all made by Nippon Aerosil Co., Ltd.; Ca—O—SiL M-5, MS-7, MS-75, HS-5, EH-5, etc., all made by CABOT Co., Ltd.; Wacker HDK N20V15, N20E, T30, T40, etc., all made by WACKER-CHEMIE GMBH,; D—C Fine Silica made by Dow Corning Co., Ltd.; and Fransol made by Fransil Co., Ltd.

It is more preferable to use fine powders of silica obtained by the vapor-phase oxidization of the silicon halide compound and then subjected to a hydrophobic treatment. Most preferably in this case, the fine powders of silica should have been subjected to the hydrophobic treatment in such a way that the degree of hydrophobicity is in the range of 30 to 80 as measured by methanol titration testing. The hydrophobic treatment may be carried out by chemically treating the fine powders of silica with an organic silicon compound capable of reacting with or being physically adsorbed onto the fine powders. Preferably in this case, the fine powders of silica obtained by the aforesaid vapor-phase oxidization of the silicon halide compound is treated with an organic silicon compound.

Examples of such an organic silicon compound are hexamethylenedisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, $\alpha$-chloroethyltrichlorosilane, $\beta$-chloroethyltrichlorosilane, chloromethyldimethylchlorosilane, triorganocsilylmercaptan, trimethylsilylmercaptan, triorganosilyl acrylate, vinyldimetylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and a hydroxyl group attached to one Si for each terminated unit. These organic compounds may be used alone or in combination of two or more.

The thus treated fine powders of silica should preferably have a particle diameter of 0.003 to 0.1 $\mu$m and especially 0.005 to 0.05 $\mu$m. The fine powders of silica used herein are commercially available under the trade names of Taranox 500 (Tarco Co., Ltd.), and AEROSIL R-972 (Nippon Aerosil Co, Ltd.).

The amount of the fluidity improver added should be 0.01 to 5 parts by weight and preferably 0.1 to 3 parts by weight per 100 parts by weight of the aforesaid resin particles. At less than 0.01 part by weight there is no effect on fluidity improvements whereas at greater than 5 parts by weight the fluidity improver scatters in the production system, resulting in fogging and character blurring.

The production process for the dry toner according to the present invention is basically made up of the following steps, as explained with reference to the production of the binder polymer (binder resin).

(1) Step of Uniform Mixing of Raw Materials

Given amounts of the binder resin, coloring agent and additives such as charge control agents are charged in Henschel Mixer 20B (Mitsui Mining Co., Ltd.) for uniform mixing. In this case, it is acceptable to prepare a master batch comprising the binder resin and coloring agent so that the master batch can be uniformly mixed with a diluting binder resin and additives such as charge control agents. The proportion of the binder resin and coloring agent in the master batch is binder resin:coloring agent=90:10 to 50:50 (parts by weight), and preferably 80:20 to 60:40 (parts by weight). Referring here to exemplary proportions for toner particle preparation, per 100 parts by weight of binder resin, the master batch coloring agent is used in an amount of 20 to 60 parts by weight and preferably 30 to 50 parts by weight, the charge control agent in an amount of 5 parts by weight or less and preferably 3 parts by weight or less, and other additives such as dispersants in a suitable amount.

(2) Step of Dispersing and Fixing Each Additive in the Binder Resin

After completion of uniform mixing, the mixture is hot kneaded together using a double-shaft extruder (PCM-30 made by Ikegai Chemical Industries, Ltd.), so that each additive is dispersed and fixed in the binder resin. Hot kneading may also be carried out using continuous kneaders such as TEM-37 (Toshiba Machine Industry Co., Ltd.) and KRC Kneader (Kurimoto Ironworks Co., Ltd.), and batch kneaders such as heat-and-pressure kneaders.

(3) Grinding Step

The kneaded product is crushed for particle size regulation. Then, the crushed product is finely ground into a mean particle diameter of 1 to 8 $\mu$m by air jet impact milling using Jet Mill 200AFG (Hosokawa Micron Co., Ltd.) or IDS-2

(made by Nippon Pneumatic Industries, Ltd.). This fine grinding may also be carried out by means of a mechanical grinding machine Turbomill (made by Kawasaki Heavy Industries, Ltd.), Super Rotor (Nisshin Engineering Co., Ltd.), etc.

(4) Classification Step

Following removal of extra fine powders, particle size regulation by pneumatic force or the rotation of a rotor is carried out for the purpose of making particle diameter distribution sharp, using a pneumatic classifier 100ATP (made by Hosokawa Micron Co., Ltd.), DSX-2 (made by Nippon Pneumatic Industries Co., Ltd.), Elbow Jet (made by Nittetsu Mining Co., Ltd.), etc.

(5) Extraneous Addition of Additives

Given amounts of the obtained colored resin particles and an extraneous additive, i.e., a fluidizing agent are charged in Henschel Mixer 20B (made by Mitsui Mining Co., Ltd.) for uniform mixing, thereby obtaining a dry toner.

For high-definition purposes, the thus obtained dry toner should preferably have a mean particle diameter reduced down to 3 to 10 $\mu$m and especially 5 to 8 $\mu$m. To improve the fluidity and cleaning capabilities of the toner, the toner should also preferably be regulated by hot air or other treatment to a circularity of 0.93 to 0.99 and especially 0.94 to 0.98.

While the present invention is now explained more specifically with reference to a number of examples, it is understood that various evaluation methods described hereinafter are carried out as mentioned below.

(1) Non-Offset Area

Using a commercially available laser printer (IBM4019) relying upon a mono-component development mode, unfixed image samples are gathered. At solid portions of the gathered samples, the amount of toner depositions is regulated to 0.30 to 0.55 mg/cm$^2$.

The unfixed image samples are passed through a fixing device in a laser printer (KL2010, Konica Co., Ltd.) (using a back side heating mode with a PFA tube fixing roller and a nip passing time of 60 msec.) while the surface temperature of the fixing roller is varied, thereby making a visual evaluation of whether or not offsets are found on the samples after fixation.

(2) Durability Testing

A toner is set in a developing unit in a commercially available laser printer (IBM4019), where it is aged with nothing supplied thereto to measure the time that elapses before filming occurs with respect to an associated member.

(3) Storability Testing

A toner is placed in a glass sample bottle, which is then kept in a 55° C. thermostat for 24 hours to make a visual evaluation of to what degree it aggregates on the following three-scale basis.

o: No change is found at all.

Δ: Slight aggregation is found but the toner is still on a practical level.

X: Striking aggregation is found and so the toner is not on any practical level.

(4) Measurement of Molecular Weight Distribution

Five (5) mg of resin or toner are dissolved in 5 g of THF, and the solution is passed through a membrane filter of 0.2 $\mu$m in pore size for removal of contaminants other than the resin component, thereby preparing a GPC sample. For a toner with a pigment and wax added thereto, the THF solution is centrifuged to obtain a THF phase with the resin component dissolved therein. Then, this phase is passed through a membrane filter of 0.2 $\mu$m in pore size to prepare a GPC sample.

Using GPC, the thus prepared sample is measured under the following conditions:

Column: Toso TSKgel-GMHHR-M

Column temperature: 30° C.

Solvent: THF

Flow rate: 1.0 ml/min.

Detector: UV detector (254 nm)

Standard sample: Monodispersed polystyrene standard sample (5) Glass Transition Point (Tg)

Ten (10) mg of resin or toner packed in an aluminum cell are measured under the following conditions, using DSC120 made by Seiko Instrument Co., Ltd.

Measuring temperature: 0 to 200° C.

Heating rate: 10° C./min.

Tg: Reading from a DSC curve upon the second heating (6) Flow Softening Point (Tm)

One (1.0) g of resin or toner is pelletized under pressure to obtain a pellet sample, which is then measured under the following conditions, using Flow Tester CFT-500D made by Shimadzu Corporation.

Heating rate: 5° C./min.

Cylinder pressure: 2.0 MPa

Die cavity diameter: 1.0 mm

Die cavity length: 1.0 mm

Tm calculation method: ½ method (7) By the term "particle diameter" used herein is intended a "mean particle diameter", which is found by measurement of relative weight distribution per particle diameter with a 100 $\mu$m aperture tube, using Coulter Counter TA-II Model (made by Coulter Counter Co., Ltd.).

(8) Pulverizability Testing

A toner bulk is charged in a jet mill (Labojett LJ made by Nippon Pneumatic Co., Ltd.) for fine grinding, and the mean particle diameter (D50) of the obtained fine powders is evaluated on the following four-scale basis:

oo: 6 $\mu$m≦mean particle diameter<10 $\mu$m o: 10 $\mu$m≦mean particle diameter<15 $\mu$m Δ: 15 $\mu$m<mean particle diameter<20 $\mu$m X: Mean particle diameter≧20 $\mu$m (9) Evaluation of Light Resistance A toner melt is used to form a 15 $\mu$m thick thin film on a slide glass, thereby preparing a sample. Using a xenon Fademeter made by Suga Testing Machine Co., Ltd., the sample is exposed to light rays for 100 hours. Then, the light resistance of the sample is evaluated from a 400 nm transmittance change (ΔT) before and after exposure to light rays on the following four-scale basis.

oo: Transmittance change<5% o: 5%≦transmittance change<10%

Δ: 10%≦transmittance change<20%

X: Transmittance change≧20%

EXAMPLE 1

Seventeen point four (17.4) parts by weight of diphenylmethane-4,4'-diisocyanate and 15.5 parts by weight of isophorone diisocyanate were mixed together and dissolved in an oil bath of 50° C. to prepare an isocyanate component. Apart from this component, 34.0 parts by weight of polyoxyethylene bisphenol A ether (Uniol DA-400 made by Nippon Oils & Fats Co., Ltd. with an OH group value of 276 KOHmg/g) and 33.1 parts by weight of polyoxypropylene bisphenol A ether (Uniol DB-400 made by Nippon Oils & Fats Co., Ltd. with an OH group value of 283 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.37\times10^4$ and a weight-average molecular weight (Mw) of $1.07\times10^4$ with Mw/Mn=2.9, Tg=67° C. and Tm=112° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.9 μm and Dmax=15 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 190° C. and a durability of 5 Hr with storability evaluated as o.

EXAMPLE 2

Ninety (90) parts by weight of the polyurethane resin obtained in Ex. 1, 8.0 parts by weight of a cyan pigment (C.I. Pigment Blue 15:3), 1.0 part by weight of a charge control agent (BONTRON E-84 made by Orient Chemical Industries, Ltd.) and 1.0 part by weight of polyolefinic wax were kneaded together using a double-shaft kneader, cooled down, and ground in a hammer mill and, then, a jet mill. The particle diameter after classification was D50=6.9 μm and Dmax=15 μm.

One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 3 Hr with storability evaluated as o.

EXAMPLE 3

Seventeen point six (17.6) parts by weight of diphenylmethane-4,4'-diisocyanate and 14.5 parts by weight of norbornane diisocynate were mixed together and dissolved to prepare an isocyanate component. Apart from this component, 44.6 parts by weight of polyoxyethylene bisphenol A ether (Uniol DA-400 made by Nippon Oils & Fats Co., Ltd. with an OH group value of 276 KOHmg/g) and 23.4 parts by weight of polyoxypropylene bisphenol A ether (Uniol DB-400 made by Nippon Oils & Fats Co., Ltd. with an OH group value of 283 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.47\times10^4$ and a weight-average molecular weight (Mw) of $1.22\times10^4$ with Mw/Mn=2.6, Tg=63° C. and Tm=105° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.8 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 100 to 190° C. and a durability of 3 Hr with storability evaluated as o.

EXAMPLE 4

The isocyanate and polyol components prepared in Example 3 were charged at the proportion referred to therein into the impact mixer shown in FIG. 1, and the raw mixture leaving the mixer was fed onto the conveyor 1 at 10 kg/Hr. Then, the raw mixture was passed over 30 minutes through the reactor 2 controlled in such a way that the raw mixture was heated to 90° C., thereby achieving polymerization. The resin discharged from the conveyor was placed in a tray, which was in turn charged in an atmospheric furnace for a 3-hour heat treatment at 130° C. The obtained polyurethane resin had a number-average molecular weight (Mn) of $0.42\times10^4$ and a weight-average molecular weight (Mw) of $1.13\times10^4$ with Mw/Mn=2.7, Tg=61° C. and Tm=103° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.4 μm and Dmax=14 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 100 to 180° C. and a durability of 3 Hr with storability evaluated as o.

EXAMPLE 5

The isocyanate and polyol components prepared in Example 3 were charged at the proportion referred to therein and 2 kg/Hr into the double-shaft extrusion reactor system shown in FIG. 2. The double-shaft extrusion reactor system was operated under the conditions of L/D=45, barrel inlet temperature=110° C., intermediate temperature=90° C., outlet temperature=90° C. and residence time=15 minutes. The resin discharged from the double-shaft extrusion reactor system was placed in a tray, which was in turn charged in an atmospheric furnace for a 3-hour heat treatment at 130° C. The obtained polyurethane resin had a number-average molecular weight (Mn) of $0.43\times10^4$ and a weight-average molecular weight (Mw) of $1.12\times10^4$ with Mw/Mn=2.6, Tg=63° C. and Tm=103° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.5 μm and Dmax=14 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 100 to 170° C. and a durability of 2 Hr with storability evaluated as o.

EXAMPLE 6

The isocyanate and polyol components prepared in Example 3 were charged at the proportion referred to therein and 2 kg/Hr into the double-shaft extrusion reactor system shown in FIG. 2. The double-shaft extrusion reactor system was operated under the conditions of L/D=80, barrel inlet temperature=115° C., intermediate temperature=90° C., outlet temperature=85° C. and residence time=25 minutes, while a mixture of 5.0 parts by weight of a cyan pigment (C.I. Pigment Blue 15:3) and 1.0 part by weight of a charge control agent (BONTRON:E-84 made by Orient Chemical Industries, Ltd.) was fed from the side feeder 12 at 0.12 kg/Hr. The colored resin discharged from the double-shaft extrusion reactor system was placed in a tray, which was in turn charged in an atmospheric furnace for a 3-hour heat treatment at 130° C. The resultant colored polyurethane resin had a number-average molecular weight (Mn) of $0.40\times10^4$ and a weight-average molecular weight (Mw) of $1.20\times10^4$ with Mw/Mn=3.0, Tg=59° C. and Tm=107° C.

The obtained colored polyurethane resin was ground in a hammer mill and, then, a jet mill. The particle diameter after classification was D50=6.8 $\mu$m and Dmax=16 $\mu$m. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 110 to 190° C. and a durability of 3 Hr with storability evaluated as o.

EXAMPLE 7

Weighed 33.2 parts by weight of diphenylmethane-4,4'-diisocyanate were used as a diisocyanate component. Apart from this component, 43.8 parts by weight of polyoxyethylene bisphenol A ether (Uniol DA-400 made by Nippon Oils & Fats Co., Ltd. with an OH group value of 276 KOHmg/g) and 23.0 parts by weight of polyoxypropylene bisphenol A ether (Uniol DB-400 made by Nippon Oils & Fats Co., Ltd. with an OH group value of 283 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 50° C. for 1 hour. Thereafter, the tray was heated up to 130° C. over 2 hours, and then held at 130° C. for 5 hours to bring the reaction to completion. The obtained polyurethane resin had a number-average molecular weight (Mn) of $0.46\times10^4$ and a weight-average molecular weight (Mw) of $1.29\times10^4$ with Mw/Mn=2.8, Tg=65° C. and Tm=107° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=7.0 $\mu$m and Dmax=18 $\mu$m. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 3 Hr with storability evaluated as o.

EXAMPLE 8

Weighed 27.8 parts by weight of hexamethylene diisocyanate were used as a diisocyanate component, and 72.2 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved with the addition of 0.02 parts by weight of a catalyst dibutyltin dichloride thereto, and the resultant solution was cast in a tray of 200 mm×300 mm, which was in turn charged into an atmospheric furnace and held therein at 50° C. for 1 hour and then at 130° C. for 5 hours to bring the reaction to completion. The obtained polyurethane resin had a number-average molecular weight (Mn) of $0.41\times10^4$ and a weight-average molecular weight (Mw) of $0.98\times10^4$ with Mw/Mn=2.4, Tg=60° C. and Tm=103° C.

Ninety (90.0) parts by weight of the obtained polyurethane resin, 8.0 parts by weight of a cyan pigment (C.I. Pigment Blue 15:3), 1.0 part by weight of a charge control agent (BONTRON E-84 made by Orient Chemical Industries, Ltd.) and 1.0 part by weight of polyolefinic wax were kneaded together using a double-shaft kneader, cooled down, and ground in a hammer mill and, then, a jet mill. The particle diameter after classification was D50=9.2 $\mu$m and Dmax=22 $\mu$m. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 150° C. and a durability of 2 Hr with storability evaluated as Δ.

EXAMPLE 9

Twenty-four point four (24.4) parts by weight of diphenylmethane-4,4'-diisocyanate and 21.9 parts by weight of isophorone diisocynate were mixed together and dissolved in an oil bath of 50° C. to prepare an isocyanate component, and weighed 53.7 parts by weight of polypropylene glycol (Uniol D-250 made by Nippon Oils & Fats Co., Ltd. with an OH group value of 446 KOHmg/g) were used as a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.49\times10^4$ and a weight-average molecular weight (Mw) of $1.37\times10^4$ with Mw/Mn=2.8, Tg=54° C. and Tm=101° C.

Ninety (90.0) parts by weight of the obtained polyurethane resin, 8.0 parts by weight of a cyan pigment (C.I. Pigment Blue 15:3), 1.0 part by weight of a charge control agent (BONTRON E-84 made by Orient Chemical Industries, Ltd.) and 1.0 part by weight of polyolefinic wax were kneaded together using a double-shaft kneader, cooled down, and ground in a hammer mill and, then, a jet mill. The particle diameter after classification was D50=9.8 $\mu$m and Dmax=22 $\mu$m. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 140° C. and a durability of 1 Hr with storability evaluated as Δ.

EXAMPLE 10

Weighed 34.4 parts by weight of diphenylmethane-4,4'-diisocyanate were used as an isocyanate component, and weighed 65.6 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved, and the resultant solution was cast in a tray of 200 mm×300 mm, which was in turn charged into an atmospheric furnace and held therein at 50° C. for 1 hour. Thereafter, the tray was held at 130° C. for 5 hours to bring the reaction to completion. The obtained polyurethane resin had a number-average molecular weight (Mn) of $0.35\times10^4$ and a weight-average molecular weight (Mw) of $1.12\times10^4$ with Mw/Mn=3.2, Tg=70° C. and Tm=109° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.9 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 125 to 200° C. and a durability of 5 Hr with storability and pulverizability evaluated as o and oo, respectively.

EXAMPLE 11

Ninety (90.0) parts by weight of the polyurethane resin obtained in Example 10, 8.0 parts by weight of a cyan pigment (C.I. Pigment Blue 15:3), 1.0 part by weight of a charge control agent (BONTRON E-84 made by Orient Chemical Industries, Ltd.) and 1.0 part by weight of polyolefinic wax were kneaded together using a double-shaft kneader, cooled down, and ground in a hammer mill and, then, a jet mill. The particle diameter after classification was D50=6.7 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 3 Hr with storability and pulverizability evaluated as o and o, respectively.

EXAMPLE 12

Twenty-nine point four (29.4) parts by weight of diphenylmethane-4,4'-diisocyanate and 6.5 parts by weight of isophorone diisocynate were mixed together and dissolved in an oil bath of 50° C. to prepare an isocyanate component, and weighed 64.1 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved, and the resultant solution was cast in a tray of 200 mm×300 mm, which was in turn charged into an atmospheric furnace and held therein at 50° C. for 1 hour. Thereafter, the tray was held at 130° C. for 5 hours to bring the reaction to completion. The obtained polyurethane resin had a number-average molecular weight (Mn) of $0.40\times10^4$ and a weight-average molecular weight (Mw) of $1.01\times10^4$ with Mw/Mn=2.5, Tg=72° C. and Tm=115° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.7 μm and Dmax=15 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 5 Hr with storability and pulverizability evaluated as o and oo, respectively.

EXAMPLE 13

Four point two (4.2) parts by weight of diphenylmethane-4,4'-diisocyanate and 23.1 parts by weight of 2,4-tolylene diisocyanate were mixed together and dissolved to prepare an isocyanate component, and weighed 72.7 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved, and the resultant solution was cast in a tray of 200 mm×300 mm, which was in turn charged into an atmospheric furnace and held therein at 70° C. for 1 hour. Thereafter, the tray was held at 130° C. for 5 hours to bring the reaction to completion. The obtained polyurethane resin had a number-average molecular weight (Mn) of $0.32\times10^4$ and a weight-average molecular weight (Mw) of $1.31\times10^4$ with Mw/Mn=4.1, Tg=70° C. and Tm=115° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=7.0 μm and Dmax=18 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 5 Hr with storability, pulverizability and light resistance evaluated as o, o and Δ, respectively.

EXAMPLE 14

Weighed 28.3 parts by weight of 2,4-xylylene diisocyanate were used as an isocyanate component, and weighed 71.7 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved with the addition thereto of 0.02 parts by weight of a catalyst dibutyltin dichloride, and the resultant solution was cast in a tray of 200 mm×300 mm, which was in turn charged into an atmospheric furnace and held therein at 70° C. for 1 hour. Thereafter, the tray was held at 130° C. for 5 hours to bring the reaction to completion. The obtained polyurethane resin had a number--average molecular weight (Mn) of $0.36\times10^4$ and a weight-average molecular weight (Mw) of $1.36\times10^4$ with Mw/Mn=3.8, Tg=62° C. and Tm=105° C.

Ninety-one (91.0) parts by weight of the obtained polyurethane resin, 8.0 parts by weight of a cyan pigment (C.I.

Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=7.2 μm and Dmax=18 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 110 to 190° C. and a durability of 5 Hr with storability, pulverizability and light resistance evaluated as o, o and Δ, respectively.

EXAMPLE 15

Weighed 30.2 parts by weight of norbornane diisocyanate were used as an isocyanate component, and weighed 69.8 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved with the addition thereto of 0.02 parts by weight of a catalyst dibutyltin dichloride, and the resultant solution was cast in a tray of 200 mm×300 mm, which was in turn charged into an atmospheric furnace and held therein at 50° C. for 1 hour. Thereafter, the tray was held at 130° C. for 5 hours to bring the reaction to completion. The obtained polyurethane resin had a number-average molecular weight (Mn) of $0.35\times10^4$ and a weight-average molecular weight (Mw) of $1.26\times10^4$ with Mw/Mn=3.6, Tg=72° C. and Tm=118° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.8 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 5 Hr with storability, pulverizability and light resistance evaluated as o, oo and oo, respectively.

EXAMPLE 16

Twenty-three point eight (23.8) parts by weight of norbornane diisocyanate and 7.2 parts by weight of diphenylmethane-4,4'-diisocyanate were mixed together and dissolved to prepare an isocyanate component, and weighed 68.9 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved with the addition thereto of 0.02 parts by weight of a catalyst dibutyltin dichloride, and the resultant solution was cast in a tray of 200 mm×300 mm, which was in turn charged into an atmospheric furnace and held therein at 50° C. for 1 hour. Thereafter, the tray was held at 130° C. for 5 hours to bring the reaction to completion. The obtained polyurethane resin had a number-average molecular weight (Mn) of $0.39\times10^4$ and a weight-average molecular weight (Mw) of $1.13\times10^4$ with Mw/Mn=2.9, Tg=70° C. and Tm=113° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.4 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 5 Hr with storability, pulverizability and light resistance evaluated as o, oo and oo, respectively.

EXAMPLE 17

Weighed 31.9 parts by weight of isophorone diisocyanate were used as an isocyanate component, and weighed 68.1 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved with the addition thereto of 0.02 parts by weight of a catalyst dibutyltin dichloride, and the resultant solution was cast in a tray of 200 mm×300 mm, which was in turn charged into an atmospheric furnace and held therein at 50° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.40\times10^4$ and a weight-average molecular weight (Mw) of $0.84\times10^4$ with Mw/Mn=2.1, Tg=65° C. and Tm=108° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.2 μm and Dmax=14 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 110 to 190° C. and a durability of 5 Hr with storability, pulverizability and light resistance evaluated as o, oo and oo, respectively.

EXAMPLE 18

Seven point five (7.5) parts by weight of diphenylmethane-4,4'-diisocyanate and 26.8 parts by weight of isophorone diisocyanate were mixed together and dissolved in an oil bath of 50° C. to prepare an isocyanate component, and weighed 65.7 parts by weight of polyoxypropylene bisphenol A ether (Uniol DB-400 made by Nippon Oils & Fats Co., Ltd. with an OH group value of 283 KOHmg/g) were used as a polyol component.

The isocyanate and polyol components were mixed together and dissolved, and the resultant solution was cast in a tray of 200 mm×300 mm, which was in turn charged into an atmospheric furnace and held therein at 70° C. for 1 hour. Thereafter, the tray was held at 130° C. for 5 hours to bring the reaction to completion. The obtained polyurethane resin had a number-average molecular weight (Mn) of $0.44\times10^4$ and a weight-average molecular weight (Mw) of $1.06\times10^4$ with Mw/Mn=2.4, Tg=68° C. and Tm=111° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.3 μm and Dmax=14 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 115 to 190° C. and a durability of 5 Hr with storability, pulverizability and light resistance evaluated as o, oo and o, respectively.

EXAMPLE 19

Eighteen point three (18.3) parts by weight of diphenylmethane-4,4'-diisocyanate and 16.4 parts by weight of isophorone diisocyanate were mixed together and dissolved in an oil bath of 50° C. to prepare an isocyanate component. Apart from this component, 52.5 parts by weight of polyoxyethylene bisphenol A ether (Uniol DA-400 made by Nippon Oils & Fats Co., Ltd. with an OH group value of 276 KOHmg/g) and 12.8 parts by weight of polyoxypropylene bisphenol A ether (Uniol DB-400 made by Nippon Oils & Fats Co., Ltd. with an OH group value of 283 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.40\times10^4$ and a weight-average molecular weight (Mw) of $1.12\times10^4$ with Mw/Mn=2.8, Tg=63° C. and Tm=109° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.8 μm and Dmax=15 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 3 Hr with storability and pulverizability evaluated as o and o, respectively.

EXAMPLE 20

Seventeen point five (17.5) parts by weight of diphenylmethane-4,4'-diisocyanate and 15.6 parts by weight of isophorone diisocyanate were mixed together and dissolved in an oil bath of 50° C. to prepare an isocyanate component. Apart from this component, 13.7 parts by weight of polyoxyethylene bisphenol A ether (Uniol DA-400 made by Nippon Oils & Fats Co., Ltd. with an OH group value of 276 KOHmg/g) and 53.3 parts by weight of polyoxypropylene bisphenol A ether (Uniol DB-400 made by Nippon Oils & Fats Co., Ltd. with an OH group value of 283 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.43\times10^4$ and a weight-average molecular weight (Mw) of $1.12\times10^4$ with Mw/Mn 2.6, Tg=70° C. and Tm=110° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.5 μm and Dmax=14 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 120 to 200° C. and a durability of 5 Hr with storability and pulverizability evaluated as o and o, respectively.

EXAMPLE 21

Sixteen point seven (16.7) parts by weight of diphenylmethane-4,4'-diisocyanate and 14.9 parts by weight of isophorone diisocyanate were mixed together and dissolved in an oil bath of 50° C. to prepare an isocyanate component. Apart from this component, 46.6 parts by weight of polyoxypropylene bisphenol A ether (Uniol DB-400 made by Nippon Oils & Fats Co., Ltd. with an OH group value of 283 KOHmg/g) and 21.8 parts by weight of polyoxyethylene-polyoxypropylene bisphenol A ether (Uniol DAB-800 made by Nippon Oils & Fats Co., Ltd. with an OH group value of 151 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.38\times10^4$ and a weight-average molecular weight (Mw) of $1.21\times10^4$ with Mw/Mn=3.2, Tg=64° C. and Tm=107° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=6.6 μm and Dmax=14 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 115 to 190° C. and a durability of 3 Hr with storability and pulverizability evaluated as o and oo, respectively.

EXAMPLE 22

Eighteen point four (18.4) parts by weight of diphenylmethane-4,4'-diisocyanate and 15.2 parts by weight of norbornane diisocyanate were mixed together and dissolved in an oil bath of 50° C. to prepare an isocyanate component. Apart from this component, 19.8 parts by weight of polyoxyethylene bisphenol A ether (Uniol DA-400 made by Nippon Oils & Fats Co., Ltd. with an OH group value of 276 KOHmg/g), 38.6 parts by weight of polyoxypropylene bisphenol A ether (Uniol DB-400 made by Nippon Oils & Fats Co., Ltd. with an OH group value of 283 KOHmg/g) and 8.1 parts by weight of polyoxyethylene bisphenol A ether (Uniol DA-550 made by Nippon Oils & Fats Co., Ltd. with an OH group value of 226 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.33\times10^4$ and a weight-average molecular weight (Mw) of $1.32\times10^4$ with Mw/Mn=4.0, Tg=60° C. and Tm=104° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=7.0 μm and Dmax=18 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 100 to 180° C. and a durability of 3 Hr with storability and pulverizability evaluated as o and o, respectively.

EXAMPLE 23

Eighteen (18.0) parts by weight of diphenylmethane-4,4'-diisocyanate and 14.8 parts by weight of norbornane diisocyanate were mixed together and dissolved in an oil bath of 50° C. to prepare an isocyanate component. Apart from this component, 56.5 parts by weight of polyoxypropylene bisphenol A ether (Uniol DB-400 made by Nippon Oils & Fats Co., Ltd. with an OH group value of 283 KOHmg/g) and 10.7 parts by weight of polyoxyethylene bisphenol A ether (Uniol DA-700 made by Nippon Oils & Fats Co., Ltd. with an OH group value of 169 KOHmg/g) were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of $0.39\times10^4$ and a weight-average molecular weight (Mw) of $1.29\times10^4$ with Mw/Mn=3.3, Tg=63° C. and Tm=108° C.

Ninety-one (91.0) parts by weight of the obtained polyurethane resin, 8.0 parts by weight of a cyan pigment (C.I. Pigment Blue 15:3) and 1.0 part by weight of a charge control agent (BONTRON E-84 made by Orient Chemical Industries, Ltd.) were kneaded together using a double-shaft kneader, cooled down, and ground in a hammer mill and, then, a jet mill. The particle diameter after classification was D50=7.0 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 110 to 190° C. and a durability of 3 Hr with storability and pulverizability evaluated as o and oo, respectively.

COMPARATIVE EXAMPLE 1

Twenty-one point seven (21.7) parts by weight of diphenylmethane-4,4'-diisocyanate and 19.4 parts by weight of isophorone diisocyanate were mixed together and dissolved in an oil bath of 50° C. to prepare an isocyanate component. Apart from this component, 55.7 parts by weight of polyoxypropylene bisphenol A ether (Uniol DB-400 made by Nippon Oils & Fats Co., Ltd. with an OH group value of 283 KOHmg/g) and 3.2 parts by weight of ethanol were mixed together to prepare a polyol component.

The isocyanate and polyol components were mixed together and dissolved, and the resultant solution was cast in a tray of 200 mm×300 mm, which was in turn charged into an atmospheric furnace and held therein at 30° C. for 5 hours. Thereafter, the tray was heated up to 130° C. over 10 hours, and then held at 130° C. for 5 hours to bring the reaction to completion. The obtained polyurethane resin had a number-average molecular weight (Mn) of 870 and a weight-average molecular weight (Mw) of 3,300 with Mw/Mn=3.8, Tg=62° C. and Tm=102° C.

Ninety (90.0) parts by weight of the obtained polyurethane resin, 8.0 parts by weight of a cyan pigment (C.I. Pigment Blue 15:3), 1.0 part by weight of a charge control agent (BONTRON E-84 made by Orient Chemical Industries, Ltd.) and 1.0 part by weight of polyolefinic wax were kneaded together using a double-shaft kneader, cooled down, and ground in a hammer mill and, then, a jet mill. The particle diameter after classification was D50=6.3 μm and Dmax=16 μm. One hundred (100) parts by weight of the obtained particles were mixed and stirred with 1.5 parts by weight of hydrophobic silica (of 20 nm in particle diameter) in a Henschel mixer to obtain a blue toner. This toner was found to have a non-offset area of 115 to 140° C. and such a durability that filming occurred within 20 minutes with storability evaluated as Δ.

I claim:

1. A dry toner, comprising as a binder resin a polymer that is obtained by bulk polymerization of a compound having at least two isocyanate groups and a compound having at least two functional groups, each containing active hydrogen, contains an urethane bond or urea bond in its main chain and has a number-average molecular weight, Mn, of 1,500 to 20,000 as measured on a polystyrene basis.

2. The dry toner according to claim 1, wherein said compound having at least two isocyanate groups is a polyisocyanate represented by the following formula (1):

Formula (1)

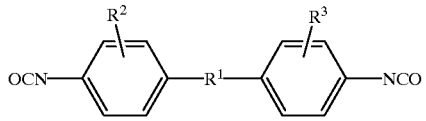

where $R^1$ is an alkylene group selected from the group consisting of methylene, ethylene and —$C(CH_3)_2$— groups, and $R^2$ and $R^3$ are each a group selected from the group consisting of an alkyl or alkoxy group having 4 or less carbon atoms and a halogen.

3. The dry toner according to claim 1, wherein said compound having at least two isocyanate groups is an alicyclic diisocyanate compound with two isocyanate groups attached directly or via an alkylene group to a cyclic aliphatic hydrocarbon.

4. The dry toner according to claim 3, wherein said alicyclic diisocyanate is isophorone diisocyanate.

5. The dry toner according to claim 1, wherein said alicyclic diisocyanate compound is a polyisocyanate represented by the following formula (2):

Formula (2)

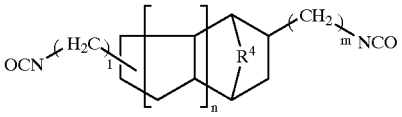

where $R^4$ is selected from the group consisting of a single bond, a methylene group, an ethylene group and a —$C(CH_3)_2$— group, l and m are each an integer of 1 to 5, and n is an integer of 0 to 2.

6. The dry toner according to claim 1, wherein said compound having at least two functional groups, each containing active hydrogen, is a polyoxyalkylene bisphenol A ether compound represented by the following formula (3):

Formula (3)

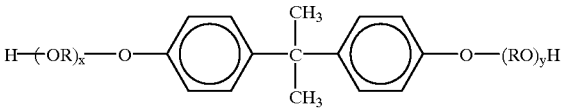

where R and R may be identical with or different from each other and are each an ethylene or propylene group, and x and y are each an integer of 1 or greater with the proviso that the average value of x+y is 2 to 12.

7. The dry toner according to claim 1, wherein said polymer has a weight-average molecular weight Mw to number-average molecular weight Mn ratio of 1.5 to 20.

8. A dry toner production process, wherein a polymer containing an urethane bond or urea bond in its main chain and having a number-average molecular weight Mn of 1,500 to 20,000 as measured on a polystyrene basis is obtained by bulk polymerization of a polyisocyanate having at least two isocyanate groups and a compound having at least two function groups, each having active hydrogen, in the absence of any solvent, and said polymer is then kneaded with a coloring agent, followed by grinding.

9. The dry toner production process according to claim 8, wherein said bulk polymerization is continuously carried out in a belt form of reactor vessel passing through a tunnel form of reaction furnace set at a reaction temperature.

10. The dry toner production process according to claim 8, wherein said bulk polymerization is continuously carried out using a double-shaft extrusion reactor.

11. A dry toner production process, wherein:

a compound having at least two isocyanate groups and a compound having at least two functional groups, each having active hydrogen, are mixed together in the absence of any solvent, a mixture is continuously fed into a double-shaft extrusion reactor comprising a barrel, a barrel inlet, a side feeder provided on an intermediate portion of said barrel and a barrel outlet from said barrel inlet for bulk polymerization, thereby obtaining a polymer containing an urethane bond or urea bond in its main chain and having a number-average molecular weight Mn of 1,500 to 20,000 as measured on a polystyrene basis, and a pigment-containing additive is continuously fed from said side feeder, a kneaded mixture of said pigment-containing additive and said bulk polymerization product is continuously discharged from said barrel outlet, and the thus discharged kneaded mixture is ground.

* * * * *